United States Patent [19]

Siskind et al.

[11] Patent Number: 4,633,548

[45] Date of Patent: Jan. 6, 1987

[54] SPEED LACE STRUCTURE

[76] Inventors: Leland B. M. Siskind, 20 Mill Pond, North Andover, Mass. 01845; William A. Samaha, 14 South Park St., Bradford, Mass. 01830; Thayer S. Warshaw, 11 Tillotson Rd., Needham Heights, Mass. 02194

[21] Appl. No.: 658,506

[22] Filed: Oct. 9, 1984

[51] Int. Cl.[4] ..... A43C 1/00

[52] U.S. Cl. ..... 24/145; 24/687; 36/50

[58] Field of Search ..... 24/104, 140, 143 R, 24/141, 144, 145, 148, 620–622, 687, 691, 692; 36/50; 411/338, 339; 16/2

[56] References Cited

U.S. PATENT DOCUMENTS

| | | | |
|---|---|---|---|
| 375,677 | 12/1887 | Kyle | 411/339 X |
| 547,424 | 10/1895 | Eaton | 24/104 |
| 586,770 | 7/1897 | Kempshall | 16/2 X |
| 599,906 | 3/1898 | Kempshall | 24/148 |
| 714,191 | 11/1902 | Kempshall | 174/152 G |
| 742,206 | 10/1903 | Maurer | 411/338 X |
| 1,053,529 | 2/1913 | Neary | 24/145 |
| 1,246,724 | 11/1917 | Daggett | 24/145 |
| 2,284,814 | 6/1942 | Gookin | 24/145 |
| 3,193,950 | 7/1965 | Lion | 36/50 |
| 3,812,809 | 5/1974 | Salmon | 24/141 X |

FOREIGN PATENT DOCUMENTS

| | | | |
|---|---|---|---|
| 1182409 | 6/1959 | France | 36/50 |
| 668532 | 10/1964 | Italy | 24/145 |
| 315871 | 9/1956 | Switzerland | 24/145 |

*Primary Examiner*—William E. Lyddane
*Assistant Examiner*—James R. Brittain
*Attorney, Agent, or Firm*—Morse, Altman & Dacey

[57] ABSTRACT

A speed lace structure for footwear that allows the footwear to be put on and tightened up quickly. The speed lace structure comprises lacer assemblies and rivet assemblies combinatively secured to a footwear quarter. Each lacer assembly is formed with a lacer loop portion having peripheral lips and with opposed fastening portions provided with central openings surrounded by a plurality of gripping teeth. Each lacer assembly is made of metal provided with a fine coating of a plastic, so as to render it smooth and very slippery. Each rivet assembly includes a capped eyelet serving as an anchoring stem to fit in and though the opposed central openings of the lacer assembly, and a deformable eyelet designed to fit into one of the opposed central openings and over the capped eyelet. When the lacer assembly and the rivet assembly combinatively are secured to a footwear quarter, the eyelet deforms about the fastening portion of the lacer assembly and also about the stem of the capped eyelet, and the end of the capped eyelet deforms about the deformable eyelet. Each rivet assembly also is made of metal, and is at least partly enamelled so as to render it smooth and non-corrosive. Preferably, the peripheral lips of the lacer assembly extend tangentially with the opposed fastening portions.

4 Claims, 10 Drawing Figures

SPEED LACE STRUCTURE

BACKGROUND OF THE INVENTION

1. Field of the Invention

The present invention relates generally to lacing footwear quickly and easily and, more particularly, to a speed lace structure that allows the footwear to be tightened up quickly with but one pull on the lacing cord.

2. The Prior Art

During the past decade, various attempts have been made at designing lace structures for footwear, such as army and marine combat boots, civil emergency service boots and the like, that allow the user to put the boots on and to take them off quickly and easily without ever having to relace, to tie, to untie and to unlace them. The requirement for speed in securing footwear for a user under combat or civil emergency conditions is obvious. And only laced footwear permits the comfortable expansion and contraction of footwear about the user's foot during rapid movement, another essential requirement, especially over rough and uneven terrain.

Some of the present-day lace structures simply failed in the field. In constant use, they often pulled apart. Others tore completely out of the footwear material. Such failures have adversely impacted on their further usefulness. There is thus plenty of room left for improvements.

SUMMARY OF THE INVENTION

It is a principal object of the present invention to overcome the above disadvantages by providing a speed lace structure for footwear that allows its extensive, continuous use under adverse field conditions with good results.

More specifically, it is an object of the present invention to provide a speed lace structure for footwear that allows the footwear to be put on and to be tightened up quickly to precise fit with only one pull on the ends of a lacing cord, laced though the structure, without fraying or prematurely wearing out the lacing cord despite extensive, continuous use in the field. The speed lace structure essentially comprises a plurality of lacer assemblies and a plurality of rivet assemblies combinatively secured on opposedly facing sides of a footwear quarter. Each lacer assembly includes a lacer loop portion having peripheral lips and opposed fastening portions having central openings surrounded by a plurality of gripping teeth. Preferably, each lacer assembly is made of a non-corrosive metal, such as brass, and is clad with a plastic material, especially at the peripheral lips so as to render it smooth and slippery. Preferably, the plastic material is a linear polyamide, such as nylon. Each rivet assembly includes a capped eyelet serving as an anchoring stem to fit in and through the opposed central openings of the lacer assembly, and a deformable eyelet designed to fit over the capped eyelet. When assembled, the eyelet deforms about the fastening portion of the lacer assembly and about the stem of the capped eyelet, and the end of the capped eyelet deforms about the deformable eyelet. Preferably, each rivet assembly also is made of a corrosion resistant metal, such as brass, and is at least partly enamelled. Preferably, the peripheral lips formed on the lacer assembly extend tangentially with the opposed fastening portions so as to extend beyond the edges of the part of footwear to which the speed lace structure is attached.

Other objects of the present invention will in part be obvious and will in part appear hereinafter.

The invention accordingly comprises the speed lace structure of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection the accompanying drawings, wherein.

DETAILED DESCRIPTION OF THE PREFERRED EMBODIMENT

Figure 1:
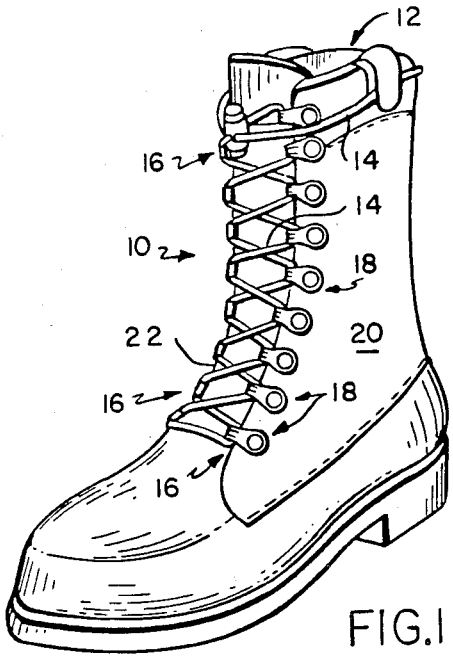
FIG. 1 is a perspective view of a footwear tightened up with a speed lace structure according to the invention.

In general, the illustrated embodiment of a speed lace structure 10 designed for putting on and tightening up a footwear 12, such as a boot, quickly to precise fit with but one pull on the ends of a lacing cord 14 comprises a lacer assembly 16 and a rivet assembly 18 firmly anchoring the speed lace structure 10 to a part 20 of the footwear 12. Preferably, the part 20 is the quarter of the footwear 12, with the speed lace structure 10 being secured to opposedly facing sides 22 thereof.

The speed lace structure 10 of the invention can be used with any type of footwear 12. Most advantageously, it is used on footwear 12, such as the illustrated combat boot, where it is of the essence that the footwear 12 be put on and/or be taken off quickly and easily without ever having to relace, tie, unlace or untie the footwear 12. Other preferred applications include emergency footwear used by firemen and medics, children's boots and bad weather footwear, men's and women's outdoor boots and fashion boots, and ice skates and roller skates. The lacing cord 14 preferably is made of long-wearing, flexible material, such as high grade looped nylon.

Figure 2:
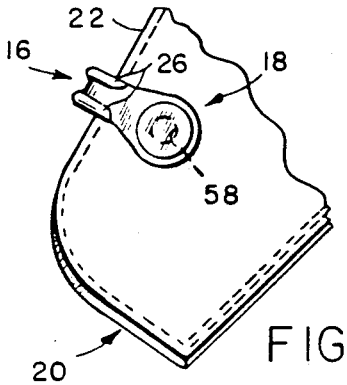
FIG. 2 depicts, on an enlarged scale, a part of the footwear shown in FIG. 1.
Figure 3:
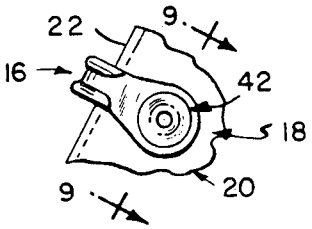
FIG. 3 is a view similar to FIG. 2 but showing it from the other side thereof.
Figure 4:
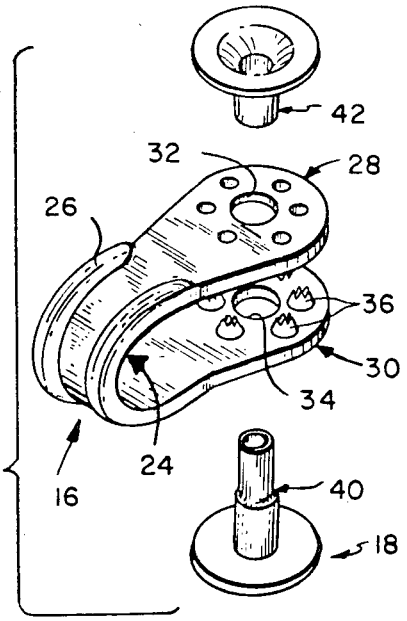
FIG. 4 is an exploded perspective view of a speed lace structure of the invention.
Figure 5:
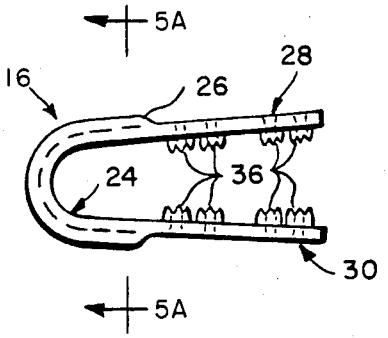
FIG. 5 is a side plan view, on an enlarged scale, of a component part of the speed lace structure shown in FIG. 4.
Figure 5A:
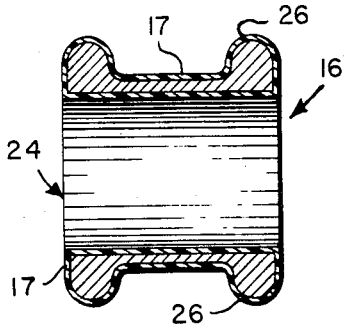
FIG. 5A is a section along the line 5A—5A of FIG. 5.
Figure 6:
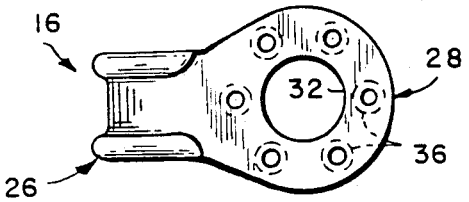
FIG. 6 is a top plan view of the part shown in FIG. 5.

As is evident from viewing FIGS. 4–6, each lacer assembly 16 is integrally formed, preferably of a non-corrosive metal such as brass, with a lacer portion 24 having peripheral lips 26, and with a pair of opposed fastening portions 28 and 30. Each of the pair of opposed fastening portions 28 and 30 is provided with a central opening 32 and 34, respectively. The central openings 32 and 34 in turn are surrounded by a plurality inwardly pointing gripping teeth 36. It is the function of these teeth 36 to bite into and to grip the footwear material, be it made of leather, plastic, cloth or a combination thereof. Preferably, these gripping teeth 36 are larger than heretofore found in such structures. It should be noted that the peripheral lips 26 extend tangentially with the opposed fastening portions 28, 30 so that when secured in place on the footwear quarter 20, as best observed in FIGS. 2 and 3, these lips 26 extend inwardly beyond the sides 22 of the quarter 20, the significance of which will be more fully evident from below.

Figure 8:
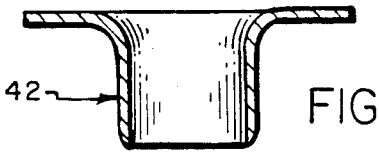
FIG. 8 is a section, on an enlarged scale, of still another component part of the speed lace structure shown in FIG. 4.
Figure 7:
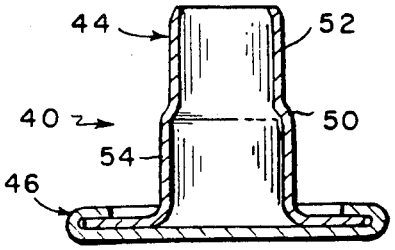
FIG. 7 is a section, on an enlarged scale, of another component part of the speed lace structure shown in FIG. 4.

In contrast to the unitary structure of the lacer assembly 16, each rivet assembly 18 is formed essentially of two parts: a capped eyelet 40, best observed in FIG. 7, and a deformable eyelet 42, best observed in FIG. 8. The capped eyelet 40 itself is formed of a stem portion 44 and of a cap portion 46, the latter draped about the bottom flared end of the stem portion 44. The stem portion 44 of the capped eyelet 40 is designed to serve as an anchoring stem for the speed lace structure 10 and as such to fit within and through the opposed central openings 32 and 34 formed in the pair of opposed fastening portions 28 and 30 of the lacer assembly 16. The stem portion 44 is formed of two sections, along its axial length, separated by a shoulder 50: a first section 52 of smaller diameter and designed to fit within the deformable eyelet 42, and a second section 54 of larger diameter.

Figure 9:
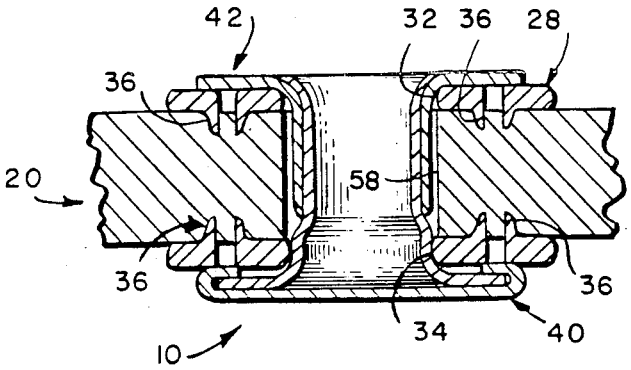
FIG. 9 is a vertical section, along the line 9—9 of FIG. 3 but on an enlarged scale, of the speed lace structure assembled and secured to a part of the footwear.

Prior to securing the speed lace structure 10 to the quarter 20 of the footwear 12, as illustrated in FIG. 9, a hole 58 first is cut in and through the quarter 20. Preferably, the diameter of the hole 58 is such as to accommodate snugly therethrough both the capped eyelet 40, and the thereon assembled deformable eyelet 42. Then, the opposed fastening portions 28 and 30 of the lacer assembly 16 are positioned over the quarter 20 such that the central openings 32 and 34 thereof are over and axially aligned with the hole 58. Whereupon the capped eyelet 40 is inserted in and through the opening 34 facing toward the visible outside of the quarter 20, and the deformable eyelet 42 is inserted in and through the opening 32 facing toward the invisible inside of the quarter 20. With the deformable eyelet 42 fitting snugly over the first section 52 of the stem postion 44 of the capped eyelet 40, it comes to rest upon the shoulder 50 thereof. Thereupon, with the aid of appropriate closing tools, which form no part of the invention, the lacer assembly 16 and the therein introduced rivet assembly 18 are combinatively assembled and secured to and within the footwear quarter 20. Specifically, the gripping teeth 36 are caused to enter into the material forming the quarter 20, be it made of leather, cloth, rubber or a combination thereof, or the like. Simultaneously therewith, the deformable eyelet 42 deforms about the second section 54 of the stem portion 44 of the capped eyelet 40. It is facilitated in that by also compressing slightly the circumference of the second section 54. Further, the deformable eyelet 42 also deforms about one 28 of the pair of opposed fastening portions 28 and 30 of the lacer assembly 16, and the free end of the stem portion 44 of the capped eyelet 40 also is peened over, i.e., deformed over the inside of the deformable eyelet 42, as can be best observed in FIG. 9.

There is thus a very firm, secure anchoring achieved in fastening the speed lace structure 10 to the footwear quarter 20. First, the gripping teeth 36 prevent the rotational displacement of the structure 10 with respect to the quarter 20. Second, the rivet assembly 18 ensures that the lacer assembly 16 cannot be pulled apart and thus dislodged from or torn out of the footwear quarter 20. Since both the lacer assembly 16 and the rivet assembly 18 are made of metal, preferably a non-corrosive metal such as brass, the securing contact is between metal to metal, further assuring a solid anchoring of the speed lace structure 10 in and to the quarter 20. It is pointed out that the diameter of the cap portion 46 of the capped eyelet 40 is chosen so as to cover the area where the gripping teeth 36 are formed in the lacer assembly 16.

In order to render the speed lace structure 10 smooth and slippery, and also enable it better to withstand the adverse effects of the hostile environment to which the footwear 12 will be exposed, the entire lacer assembly 16 is powder coated and heat treated with a as at 17, such as a linear polyamide, to provide a smooth, slippery, continuous surface. Powder coating is characterized by a low coefficient of friction coupled with a high impact resistance. Preferably, the linear polyamide is nylon, such as the one sold by the duPont Company under the trade designation of "6—6 Nylon." The powder coating 17 can be applied with a thickness from about 0.004 inch to about 0.01 inch. For most applications, a thickness between 0.004 to 0.007 suffices and is preferred. This powder coating 17 makes the lacer assembly 16 very smooth and slippery, especially around the peripheral lips 26 which come into contact with the lacing cord 14. As a result, the lacing cord 14 does not become frayed and lasts a very long time. With respect to the rivet assembly 18, at least the cap portion 46 of the capped eyelet 40 and the deformable eyelet 42 are enameled, as by a hard, baked enamel, so as also to make these parts smooth and slippery. Enamel, as used herein, defines a finely ground, resin-containing oil paint that dries harder, smoother and glossier than ordinary paint. The speed lace structure 10 thus produced can withstand the adverse effects of very high temperature extremes, found in both the arctic and in the topics, over extended time periods without becoming corroded.

Thus it has been shown and described a speed lace structure 10 for footwear 12 which allows the same to be put on and be tightened up quickly to precise fit with but one pull on the ends of a lacing cord 14, which structure 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A speed lace structure for footwear comprising:

(a) a lacer assembly integrally formed with a lacer loop portion having peripheral lips and with opposed fastening portions provided with central openings peripherally surrounded by a plurality of gripping teeth;

(b) a rivet assembly formed of a capped eyelet and of a deformable eyelet, said deformable eyelet deformably to be received over said capped eyelet;

(c) said lacer assembly coated with a plastic material so as to render said lacer loop portion, including said peripheral lips thereof, smooth and slippery;

(d) said peripheral lips extending tangentially with said opposed fastening portions;

(e) said capped eyelet serving as an anchoring stem fitting within and through said central openings of said opposed fastening portions;

(f) with said speed lace structure secured in operative position to a part of said footwear, said deformable eyelet deforming about one of said opposed fastening portions of said lacer assembly and also about said capped eyelet serving as said anchoring stem, and the free end of said capped eyelet extends through and deforms about said one of said opposed fastening portions;

(g) said capped eyelet being formed with a stem portion characterized by having two segments of different external diameters; a first segment with an external diameter to fit snugly within said deformable eyelet, and a second segment with an external diameter larger than the internal diameter of said deformable eyelet, and a smooth shoulder connecting said segments.

2. The speed lace structure of claim 1 wherein said plastic material is a linear polyamide and said coating is a thin powder coating, said linear polyamide being 6—6 Nylon and said coating having a thickness from about 0.1004 inch to about 0.01 inch.

3. A speed lace structure and a footwear in combination, said structure designed to be secured on opposedly facing side of a footwear quarter of said footwear and to draw said facing sides together with a lacing cord with but one pull thereon comprising:

(a) a plurality of lacer assemblies and a plurality of rivet assemblies combinatively secured on said opposed facing sides of said footwear quarter;

(b) each of said plurality of lacer assemblies being integrally formed with a lacer loop portion having peripheral lips and with opposed fastening portions provided with central openings peripherally surrounded by a plurality of gripping teeth, said lacing cord laced through said lacer loop portion of each of said plurality of lacer assemblies;

(c) each of said plurality of rivet assemblies formed of a capped eyelet serving as an anchoring stem to fit in and through said central openings of said opposed fastening portions and of a deformable eyelet deformably to be recieved over said capped eyelet;

(d) said plurality of lacer assemblies provided with a fine coating of a plastic material so as to render said lacer loop portions, including said peripheral lips thereof, smooth and slippery;

(e) said peripheral lips of said lacer loop portions extending beyond the edges of said opposedly facing sides of said footwear quarter;

(f) said deformable eyelet deforming about one of said opposed fastening portions and the free end of said capped eyelet extending through and deforming about aid deformable eyelet deformed about said one of said opposed fastening portions;

(g) said speed lace structure made of metal and said plurality of gripping teeth of said lacer assemblies bitingly entering into said footwear quarter and being securely anchored thereto by said plurality of rivet assemblies;

(h) said footwear quarter made of leather, wherein said gripping teeth prevent angular displacement of said plurality of lacer assemblies with respect to said footwear quarter and wherein said rivet assemblies prevent said plurality of lacer assemblies from being pulled apart or form being pulled out of said footwear quarter, and wherein said footwear quarter forms a component part of an outdoor boot selected from the group of army and marine combat boots, firemen's boots, fashion boots for men and women, children's bad weather boots, and ice skates and roller skates;

(i) said capped eyelet formed with a stem having smaller diameter section at its free end than at its capped end, and wherein said deformable eyelet initially slides snugly over said smaller diameter section of said stem, and wherein a part of said capped eyelet and said deformable eyelet are enameled.

4. A speed lace structure and a footwear in combination, said speed lace structure designed to be secured on opposedly facing sides of a footwear quarter of said footwear and to draw said facing sides together with a lacing cord with but one pull thereon comprising:

(a) a plurality of lacer assemblies and a plurality of rivet assemblies combinatively secured on said opposedly facing sides of said footwear quarter;

(b) each of said plurality of lacer assemblies being integrally formed with a lacer loop portion having peripheral lips and with opposed fastening portions provided with central openings peripherally surrounded by a plurality of gripping teeth, said lacing cord laced through said lacer loop portion of of each of said plurality of lacer assemblies;

(c) each of said plurality of rivet assemblies formed of a capped eyelet serving as an anchoring stem to fit in and through said central openings of said opposed fastening portions and of a deformable eyelet deformably to be received over said capped eyelet;

(d) said plurality of lacer assemblies provided with a fine coating of a plastic material so as to render said lacer loop portions, including said peripheral lips thereof, smooth and slippery;

(e) said peripheral lips of said lacer loop portions extending beyond the edges of said opposedly facing sides of said footwear quarter;

(f) said deformable eyelet deforming about one of said opposed fastening portions and the free end of said capped eyelet extending through and deforming about said deformable eyelet deformed about said one of said opposed fastening portions;

(g) said speed lace structure made of metal and said plurality of gripping teeth of said lacer assemblies bitingly entering into said footwear quarter and being securely anchored thereto by said plurality of rivet assemblies;

(h) said footwear quarter made of leather, wherein said gripping teeth prevent angular displacement of said plurality of lacer assemblies with respect to said footwear quarter and wherein said rivet assemblies prevent said plurality of lacer assemblies from being pulled apart or from being pulled out of said footwear quarter, and wherein said footwear quarter forms a component part of an outdoor boot selected from the group of army and marine combat boots, fireman's boots, fashion boots for men and women, children's band weather boots, and ice skates and roller skates;

(i) said capped eyelet formed with a stem provided with a smooth transitional shoulder about mdiway its axial length and delineating a smaller diameter segment forward of said shoulder toward the free end thereof, and wherein said deformable eyelet initially slides over said smaller diameter segment of said capped eyelet, and wherein a part of said capped eyelet and said deformable eyelet are enameled.

* * * * *